US005761860A

United States Patent [19]

Koike et al.

[11] Patent Number: 5,761,860

[45] Date of Patent: Jun. 9, 1998

[54] PANEL MOUNTING STRUCTURE

[75] Inventors: Sou Koike; Masao Hirano, both of Toyama-ken, Japan

[73] Assignee: YKK Architectural Products Inc., Tokyo, Japan

[21] Appl. No.: 787,008

[22] Filed: Jan. 29, 1997

[30] Foreign Application Priority Data

Feb. 1, 1996 [JP] Japan ..... 8-016485

[51] Int. Cl.[6] ..... E06B 3/964

[52] U.S. Cl. ..... 52/204.67; 52/204.7; 52/204.705; 52/204.71; 52/214; 49/401

[58] Field of Search ..... 52/204.5, 204.597, 52/204.62, 204.67, 204.69, 204.7, 204.705, 204.71, 455, 456, 214; 49/501, 503, 400, 401

[56] References Cited

U.S. PATENT DOCUMENTS

| | | | |
|---|---|---|---|
| 3,299,596 | 1/1967 | Neal et al. . | |
| 3,683,555 | 8/1972 | Kuniansky . | |
| 4,811,532 | 3/1989 | Fratti et al. | 52/204.62 X |
| 4,999,958 | 3/1991 | Harrison | 52/214 |
| 5,444,958 | 8/1995 | Lu | 52/204.67 X |
| 5,544,457 | 8/1996 | Lu | 52/204.67 X |
| 5,546,714 | 8/1996 | Kenkel | 52/204.67 X |
| 5,623,783 | 4/1997 | Kenkel | 49/501 X |

FOREIGN PATENT DOCUMENTS

| | | | |
|---|---|---|---|
| 3134742 | 3/1983 | Germany | 52/204.69 |
| 61-192077 | 11/1986 | Japan . | |
| 2141165 | 12/1984 | United Kingdom | 52/204.7 |
| 2227275 | 7/1990 | United Kingdom | 52/204.7 |

*Primary Examiner*—Christopher Kent
*Assistant Examiner*—Yvonne Horton-Richardson
*Attorney, Agent, or Firm*—Finnegan, Henderson, Farabow, Garrett & Dunner, L. L. P.

[57] ABSTRACT

A structure for mounting a panel in a panel mounting frame to form a door, window, or the like comprises bilateral vertical frame elements, an upper transverse frame element and a lower transverse frame element assembled to form a quadrangular panel mounting frame. Each of the bilateral vertical frame elements has a recessed groove and a receiving means. A first bead member is attached to each of the vertical frame elements by an attachment means inserted in the recessed groove. A second bead member is also attached to each of the vertical frame elements by an engaging means engaged with a receiving means. A panel is mounted so that each of its bilateral vertical edge portions is disposed between the first bead member and the second bead member.

4 Claims, 4 Drawing Sheets

PANEL MOUNTING STRUCTURE

BACKGROUND OF THE INVENTION

The present invention relates to a structure for mounting a panel such as a glass panel in a panel mounting frame thereby to form a door, a movable sash window, a fixed sash window or the like.

There is known a door, a movable sash window, and a fixed sash window so constructed that bilateral vertical frame elements, an upper transverse frame element and a lower transverse frame element are assembled to a quadrangular panel mounting frame and a panel such as a glass panel is mounted therein.

In this kind of door or window, since it is desired that a panel is mounted after the frame elements are assembled to a quadrangular panel mounting frame, the following structure is generally adopted. (Here, terms "first side" and "second side" are respectively used to indicate the sides corresponding to one side and the other side of a door or a window to be constructed, and terms "inside" and "outside" are respectively used to indicate the sides corresponding to the inside and outside of a quadrangular panel mounting frame.) The bilateral vertical frame elements have respectively a panel support portion integrally formed at the first side portion of their inside surface, while a bead member is respectively attached detachably to the second side portion of their inside surface. The upper and lower transverse frame elements have respectively a panel support recess which is defined by panel support portions integrally formed at both the first and second side portions of their inside surface. After the frame elements are assembled to a quadrangular panel mounting frame, upper and lower transverse edge portions of a panel are respectively inserted in the panel support recesses of the upper and lower transverse frame elements by moving the panel obliquely up and down. Then, the bead members are attached to the bilateral vertical frame elements.

In this structure, owing to the panel support portions of the bilateral vertical frame elements, the panel does not come off the panel mounting frame even when the panel is pressed by large wind pressure.

On the other hand, the frame elements are assembled to a quadrangular panel mounting frame in the manner that the longitudinal end surfaces of the upper and lower transverse frame elements are made to abut against and connected to the inside surfaces of the bilateral vertical frame elements at their upper and lower portions. Therefore, it is necessary to cut off the upper and lower portions of the panel support portions of the bilateral vertical frame elements, in order to provide flat inside surfaces at the upper and lower portions of the bilateral vertical frame elements against which the upper and lower transverse frame elements are made to abut. This requires troublesome work.

In order to solve the above problem, Japanese Unexamined Utility Model Publication SHO 61-192077 and U.S. Pat. No. 3,299,596 have proposed a structure in which the frame elements have respectively a flat inside surface, to which bead members are attached at both the first and second side.

In this structure, the bead members are attached to the frame elements by snap-like engagement with receiving pieces formed at the inside surfaces of the frame elements. This type of engagement is easy to disengage. The first side bead member may come off the frame element when the panel is pressed toward the first side bead member by large wind pressure, or the frame element is curved and/or deformed toward the first side bead member by large wind pressure.

SUMMARY OF THE INVENTION

An object of the present invention is to provide a structure for mounting a panel in a panel mounting frame which can substantively eliminate defects or drawbacks encountered in the prior art described above.

This and other objects can be achieved according to the present invention by a structure for mounting a panel in a panel mounting frame thereby to form a door, a movable sash window, a fixed sash window or the like, the structure comprising bilateral vertical frame elements, an upper transverse frame element and a lower transverse frame element assembled to a quadrangular panel mounting frame, wherein each of the bilateral vertical frame elements has, on its inside surface directed to the inside of the quadrangular panel mounting frame, a recessed groove and a receiving means, the recessed groove being formed on a first side of the inside surface corresponding to a first side of a door or a window to be formed, the receiving means being integrally formed on a second side of the inside surface corresponding to a second side of a door or a window to be formed, a first bead member provided with an attachment means adapted to be slid into the recessed groove in the longitudinal direction of the vertical frame element is attached on the first side of the inside surface of each of the vertical frame elements with the attachment means inserted in the recessed groove, a second bead member provided with an engaging means adapted to be detachably engaged with the receiving means is attached on the second side of the inside surface of each of the vertical frame elements with the engaging means engaged with the receiving means, and a panel is so mounted that each of its bilateral vertical edge portions is disposed between the first bead member and the second bead member.

In this structure, the first side bead member is provided with an attachment means adapted to be slid in the longitudinal direction of the vertical frame member into a recessed groove formed on the vertical frame element, and the first bead member is attached to the vertical frame element with the attachment means inserted in the recessed groove by sliding movement. Thus inserted attachment means does not come off the recessed groove even when the first bead member is pressed with large force, or the vertical frame element is curved and/or deformed, or the panel is pressed toward the first bead member by large wind pressure. Therefore, the first bead member does not come off the vertical frame element.

On the other hand, the second side bead member is provided with an engaging means adapted to be detachably engaged with a receiving means formed on the vertical frame element, and the second side bead member can be easily attached to the vertical frame element by engaging the engaging means with the receiving means after the frame elements are assembled to a quadrangular panel mounting frame.

The nature and further features of the present invention will be made clearer from the following description made with reference to the accompanying drawings.

DESCRIPTION OF THE PREFERRED EMBODIMENT

The present invention will be described hereunder with reference to a preferred embodiment where the present invention is applied to a door.

First, it is to be noted that in the following description, terms "first side" and "second side" are respectively used to indicate the sides corresponding to one side and the other side of a door, terms "inside" and "outside" are respectively used to indicate the sides corresponding to the inside and the outside of a quadrangular panel mounting frame, and a term "inwardly" is used to indicate the direction directed to the inside of a quadrangular panel mounting frame.

Figure 1:
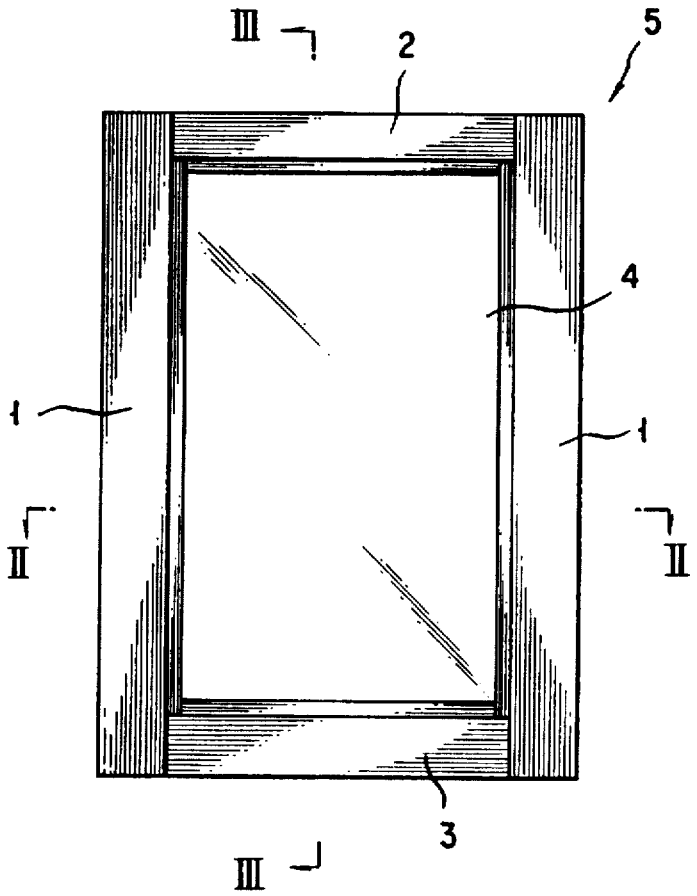
FIG. 1 is a front view of a door to which the present invention is applicable.

As shown in FIG. 1, a quadrangular panel mounting frame is constructed by connecting upper and lower transverse frame elements 2 and 3 to inside surfaces of bilateral vertical frame elements 1 at their upper and lower portions, respectively. A panel 4 is mounted in this panel mounting frame, thereby to form a door 5.

Figure 2:
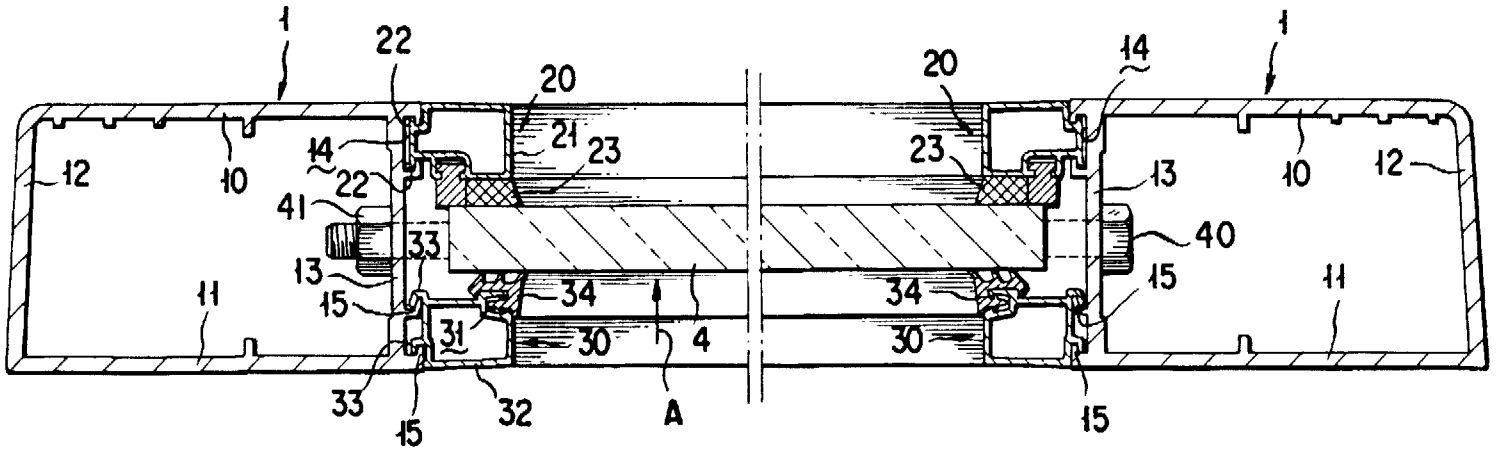
FIG. 2 is a cross sectional view taken along the line II—II in FIG. 1.

As shown in FIG. 2, each of vertical frame elements is an elongated hollow member of rectangular cross section and comprises a first side vertical plate 10, a second side vertical plate 11, an outside vertical plate 12 and an inside vertical plate 13. The inside vertical plate 13 provides an inside surface of the vertical frame element 1.

The inside vertical plate 13 has an inwardly opening recessed groove 14 formed at its first side portion and a pair of hook-like shaped receiving pieces 15 integrally formed at its second side portion. The recessed groove 14 extends continuously in the longitudinal direction of the inside vertical plate 13.

A first side bead member 20 is attached to the recessed groove 14. The first side bead member 20 comprises a hollow body 21 and a pair of attachment pieces 22 integrally formed therewith. The attachment pieces 22 are adapted to be slid into the recessed groove 14 in its longitudinal direction. The first side bead member 20 is attached to the inside surface of the vertical frame element 1 by sliding the pair of attachment pieces 22 into the recessed groove 14 in its longitudinal direction.

Thus inserted pair of attachment pieces 22 do not come off the recessed groove 14 even when the first side bead member 20 is pressed with large force in the direction perpendicular to the door surface, or the vertical frame element 1 is curved and/or deformed. Therefore, the first side bead member 20 does not come off the vertical frame element 1.

On the other hand, a second side bead member 30 is attached to the pair of receiving pieces 15, 15. The second side bead member 30 comprises a hollow body 32 and a pair of hook-like shaped engaging pieces 33 integrally formed therewith. The hollow body 32 is provided with a gasket fitting groove 31. The second side bead member 30 is attached to the vertical frame element 1 by engaging the pair of engaging pieces 33 with the pair of receiving pieces 15.

Figure 3:
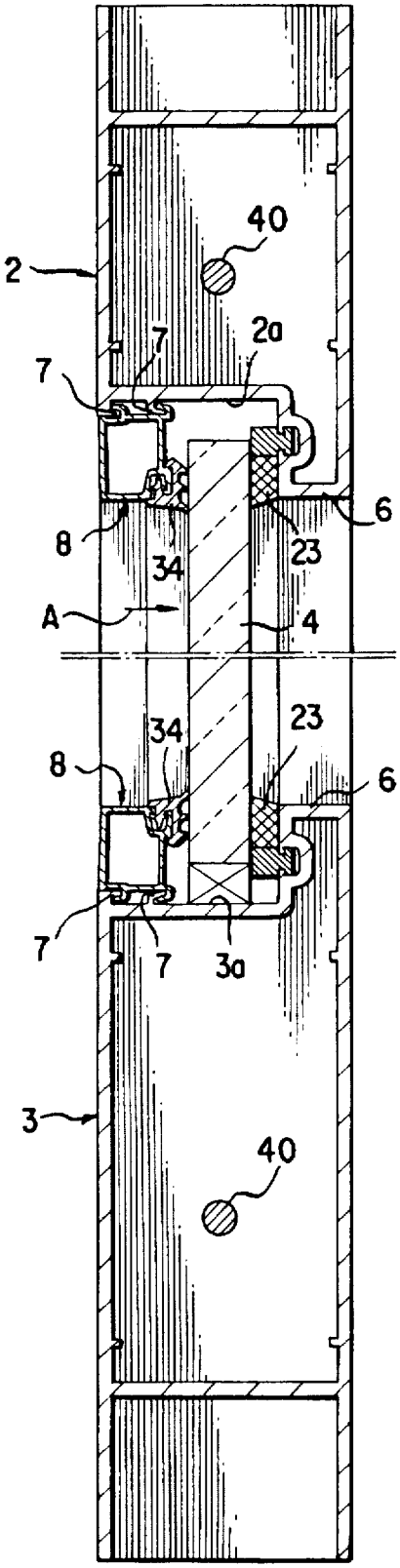
FIG. 3 is a vertical sectional view taken along the line III—III in FIG. 1.

As shown in FIG. 3, the upper transverse frame element 2 and the lower transverse frame element 3 have, at the first side portions of their inside surfaces **2*a*, 3*a*, an integrally formed and inwardly protruded panel support portion 6, respectively, and at the second side portions of their inside surfaces 2*a*, 3*a*, a pair of integrally formed hook-like shaped receiving pieces 7 respectively. A bead member 8 of substantively the same configuration as the second side bead member 30 as described above is attached to each pair of receiving pieces 7** by engagement.

As shown in FIG. 2, bilateral vertical edge portions of the panel 4 extend between the first side bead member 20 and the second side bead member 30, respectively. Sealant 23 is applied between the first side surface of the vertical edge portion of the panel 4 and the first side bead member 20, while a gasket 34 is fitted between the second side surface of the vertical edge portion of the panel 4 and the second side bead member 30. The gasket 34 is fitted and held in the gasket fitting groove 31.

As shown in FIG. 3, upper and lower transverse edge portions of the panel 4 extend between the panel support portion 6 and the bead member 8 respectively of the upper and lower transverse frame elements 2 and 3. Sealant 23 is applied between the first side surface of the upper transverse edge portion of the panel 4 and the panel support portion 6 of the upper transverse frame element 2 and between the first side surface of the lower transverse edge portion of the panel 4 and the panel support portion 6 of the lower transverse frame element 3, respectively, while a gasket 34 is fitted between the second side surface of the upper transverse edge portion of the panel 4 and the bead member 8 attached to the upper transverse frame element 2 and between the second side surface of the lower transverse edge portion of the panel 4 and the bead member 8 attached to the lower transverse frame element 3, respectively.

In this structure, the first side bead member 20 does not come off the vertical frame element 1 even when the panel 4 is pressed toward the first side bead member 20 by large wind pressure as indicated by an arrow A, or the vertical frame element 1 is curved and/or deformed toward the first side bead member 20.

The panel mounting frame is assembled as follows.

Figure 4:
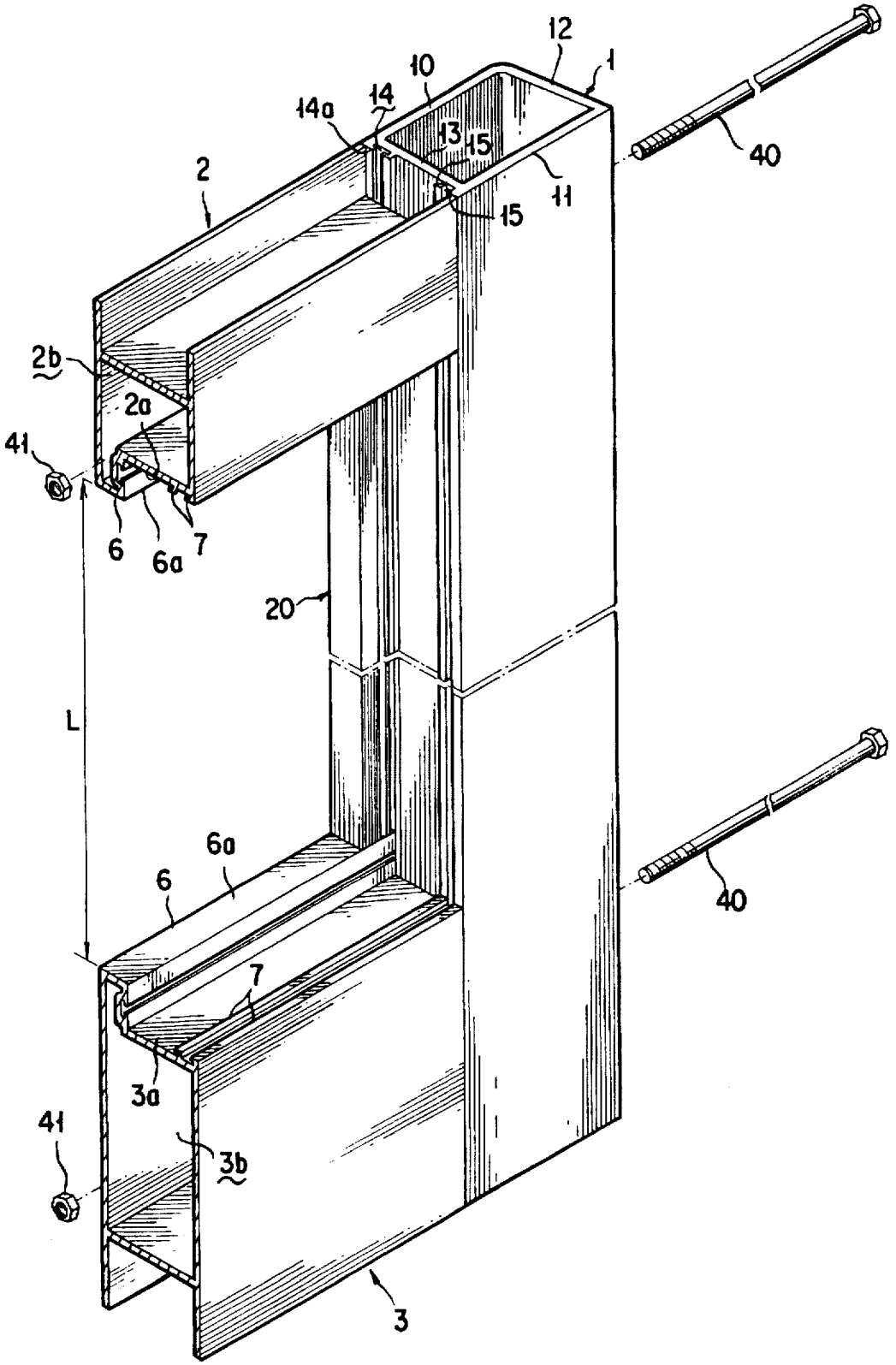
FIG. 4 is a perspective view showing a connecting portion of upper and lower transverse frame elements to a vertical frame element.

As shown in FIG. 4, the vertical frame element 1, the upper transverse frame element 2 and the lower transverse frame element 3 are of the same dimension in the door thickness direction. Longitudinal end surfaces of the upper and lower transverse frame elements 2 and 3 are made to abut against the inside vertical plate 13 of the vertical frame element 1 (more specifically, against one of hook pieces **14*a* defining the recessed groove 14 and one of the receiving pieces 15). Elongated bolts 40 are inserted through bolt holes (not shown) which are formed at upper and lower portions of the outside vertical plate 12 of the vertical frame element 1 to extend through the inside vertical plate 13, then through the hollow portion 2*b* of the upper transverse frame element 2 and the hollow portion 3*b* of the lower transverse frame element 3, respectively, and then through the inside vertical plate 13 of the other vertical frame element 1. Then, the bolts 40 are respectively secured to this inside vertical plate 13 by nuts 41, thereby to make this vertical frame element 1 abut against and connected with the other longitudinal end surfaces of the upper and lower transverse frame elements 2 and 3**, thereby to form a quadrangular panel mounting frame.

As is clear from the above description, in the structure according to the present invention, the panel mounting frame can be assembled by using the upper and lower transverse frame elements 2 and 3 having their longitudinal ends cut perpendicular to their longitudinal direction, and that without need of making any work to the vertical frame element 1. Further, one of the pair of hook pieces **14*a* defining the recessed groove 14 is provided as an extension of the first side vertical plate 10, while one of the pair of receiving pieces 15 is provided as an extension of the second side vertical plate 11**. Therefore, the panel mounting frame is allowed to have flat surfaces on both the first and second sides.

The first side bead members 20 are respectively attached to the bilateral vertical frame elements by sliding the attachment pieces 22 into the recessed grooves 14 in their longitudinal direction before the frame elements are assembled to the quadrangular panel mounting frame. As shown in FIG. 4, first side bead member is of the same longitudinal length as a distance L between the panel support portions 6 of the upper and lower transverse frame elements 2 and 3, so that the longitudinal end surfaces of the first side bead member 20 are in contact with the inside surfaces 6*a* of the panel support portions 6 of the upper and lower transverse frame elements 2 and 3, respectively.

After the frame elements are assembled to the quadrangular panel mounting frame in the manner described above, then the panel 4 is mounted in the panel mounting frame, the second side bead members 30 and the bead members 4 are attached to the respective frame elements, and then the sealant 23 and the gaskets 34 are applied to fix the panel 4. Since the second side bead members 30 and the bead members 8 are so provided that they are attached to the respective frame elements by engaging the engaging pieces 33 with the receiving pieces 15 or 7, respectively, the second side bead members 30 and the bead members 8 can be easily attached to the respective frame elements after the frame elements are assembled to the quadrangular panel mounting frame.

In the above description, the present invention is described with respect to the embodiment where the present invention is applied to form a door. Substantively the same description applies to the case that where the present invention is applied to form a movable sash window. In the case that the present invention is applied to form a fixed sash window, only the structure that the first side and second side bead members are attached to the inside surfaces of bilateral vertical frame elements in the same manner as in the described embodiment is needed.

What is claimed is:

1. A structure for mounting a panel in a panel mounting frame thereby to form a door, a movable sash window, a fixed sash window or the like, said structure comprising bilateral vertical frame elements, each having an inside surface, an upper transverse frame element, and a lower transverse frame element assembled to form a quadrangular panel mounting frame, wherein each of said bilateral vertical frame elements has, on its inside surface directed to the inside of said quadrangular panel mounting frame, a recessed groove and a receiving means, said recessed groove being formed on a first side of said inside surface corresponding to a first side of a door or a window to be formed, said receiving means being integrally formed on a second side of said inside surface corresponding to a second side of a door or a window to be formed, a first bead member provided with an attachment means adapted to be slid into said recessed groove in the longitudinal direction of said vertical frame element is attached on said first side of said inside surface of each of said vertical frame elements with said attachment means inserted in said recessed groove, a second bead member provided with an engaging means adapted to be detachably engaged with said receiving means is attached on said second side of said inside surface of each of said vertical frame elements with said engaging means engaged with said receiving means, and a panel is so mounted that each of its bilateral vertical edge portions is disposed between said first bead member and said second bead member, wherein said attachment means of said first bead member is a pair of attachment pieces, and wherein said first side bead member is attached to the recessed groove, the first side bead member comprises a hollow body and the pair of attachment pieces integrally formed therewith, said attachment pieces are adapted to be slid into the recessed groove in its longitudinal direction, said first side bead member is attached to the inside surface of the vertical frame element by sliding the pair of attachment pieces into the recessed groove in its longitudinal direction.

2. The structure according to claim 1, wherein said receiving means of said vertical frame element is a pair of hook-shaped receiving pieces and said engaging means of said second bead member is a pair of hook-shaped engaging pieces.

3. The structure according to claim 1, wherein each of said upper and lower transverse frame elements has, on its inside surface directed to the inside of said quadrangular panel mounting flame, a panel support portion protruding to the inside of said quadrangular panel mounting frame and a receiving means, said panel support portion being integrally formed on a first side of said inside surface corresponding to a first side of a door or a window to be formed, said receiving means being integrally formed on a second side of said inside surface corresponding to a second side of a door or a window to be formed, a third bead member provided with an engaging means adapted to be detachably engaged with said receiving means is attached on said second side of said inside surface of each of said upper and lower transverse frame elements with said engaging means engaged with said receiving means, and said panel is so mounted that each of its upper and lower transverse edge portions is disposed between said panel support portion an said third bead member.

4. The structure according to claim 3, herein said receiving means of each of said upper and lower transverse frame elements is a pair of hook-shaped receiving pieces and said engaging means of said third bead member is a pair of hook-shaped engaging pieces.

* * * * *

UNITED STATES PATENT AND TRADEMARK OFFICE

CERTIFICATE OF CORRECTION

| | | |
|---|---|---|
| PATENT NO. | : | 5,761,860 |
| DATED | : | June 9, 1998 |
| INVENTOR(S) | : | Sou KOIKE et al. |

It is certified that error appears in the above-identified patent and that said Letters Patent is hereby corrected as shown below:

Claim 3, Column 6, line 49, "an said" should read --and said--.

Claim 4, Column 6, line 51, "herein" should read --wherein--.

Signed and Sealed this

Twenty-seventh Day of April, 1999

*Attest:*

Q. TODD DICKINSON

*Attesting Officer*

*Acting Commissioner of Patents and Trademarks*